US006008775A

United States Patent [19]

Bobowicz et al.

[11] Patent Number: 6,008,775

[45] Date of Patent: Dec. 28, 1999

[54] DUAL POLARIZED ELECTRONICALLY SCANNED ANTENNA

[75] Inventors: Daniel Bobowicz; William B. Yablon, both of Elkridge; Dennis A. Grube, Ellicott City; Norman E. Thurlow, Severna Park; Lawrence J. Hunter, Linthicum; Jose A. Coronado, Glen Burnie; Jeffrey J. Dickstein, Ellicott City; Timothy M. Fertiq, Pasadena; Alex E. Bailey, Hampstead; John Chino, Arnold; Andrea Curbean, Baltimore; Tapan Gupta, Ellicott City; Ronnie L. Starling, Columbia; Steven N. Stitzer, Ellicott City; Herbert J. Henderson, Laurel; Terry L. Reeve, Annapolis; Robert G. Schmier, Columbia, all of Md.

[73] Assignee: Northrop Grumman Corporation, Los Angeles, Calif.

[21] Appl. No.: 08/880,114

[22] Filed: Jun. 20, 1997

Related U.S. Application Data

[60] Provisional application No. 60/032,707, Dec. 12, 1996.

[51] Int. Cl.[6] ..... H01Q 13/10

[52] U.S. Cl. ..... 343/853; 343/770; 343/771; 343/778

[58] Field of Search ..... 343/770, 771, 343/772, 778, 767, 850, 853, 787, 848; H01Q 13/10

[56] References Cited

U.S. PATENT DOCUMENTS

| | | | |
|---|---|---|---|
| 3,281,851 | 10/1966 | Goebels | 343/771 |
| 3,518,689 | 6/1970 | Algeo et al. | 343/778 |
| 3,599,216 | 8/1971 | Paine | 343/771 |
| 3,701,162 | 10/1972 | Seaton | 343/771 |
| 4,716,415 | 12/1987 | Kelly | 343/771 |
| 5,140,335 | 8/1992 | Staehlin et al. | 343/778 |
| 5,543,810 | 8/1996 | Park | 343/771 |

FOREIGN PATENT DOCUMENTS

| | | |
|---|---|---|
| 0543509 | 5/1993 | European Pat. Off. . |
| 0547274 | 6/1993 | European Pat. Off. . |
| 3915048 | 11/1990 | Germany . |
| 2191044 | 12/1987 | United Kingdom . |

*Primary Examiner*—Don Wong
*Assistant Examiner*—Tho Phan

[57] ABSTRACT

A phased array includes a first plurality of radiators having a first polarization and a second plurality of radiators having a second polarization, different from said first polarization. The phased array is constructed such that radiating patterns of the first and second plurality of radiators are congruent. The radiators are constructed so that they radiating apertures thereof can occupy virtually the same space, i.e., the spacing of the radiating elements is less than a wavelength. Other features provided allow this compactness to be achieved. Impedance matching features are integrated into the radiators themselves. The elevation assemblies of the radiators are mated together, and then are coupled across to their respective azimuth assemblies. Two azimuth assemblies for either type of polarization may be provided when monopulse operation is required. Assemblies for both polarizations transmit sequentially, but receive simultaneously, thus allowing a complete polarization matrix to be collected with two pulse transmissions.

40 Claims, 14 Drawing Sheets

FIG.3a
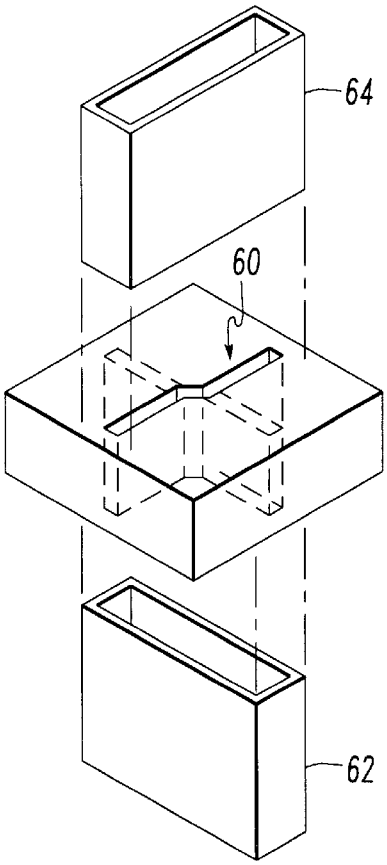
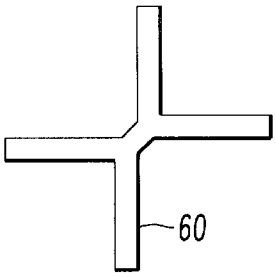
FIG.3b
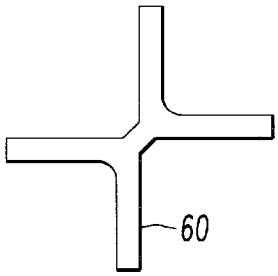
FIG.3c
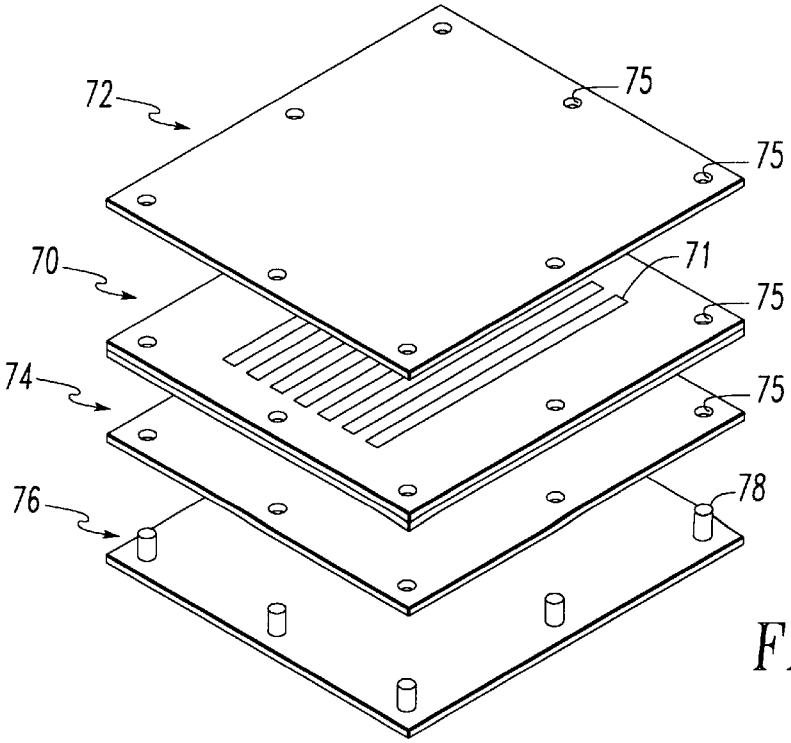
FIG.4a

FIG.5a
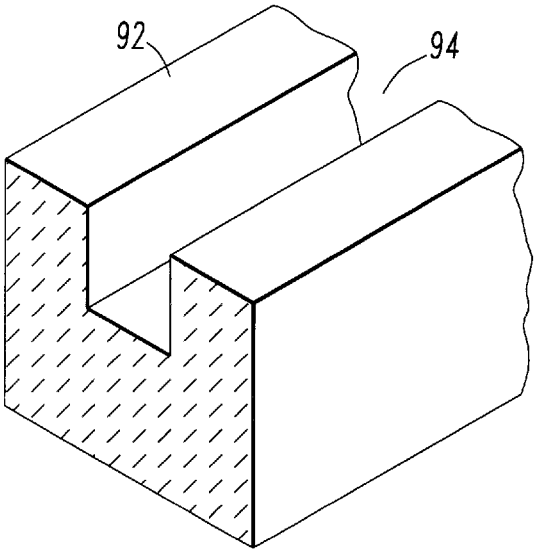
FIG.5b
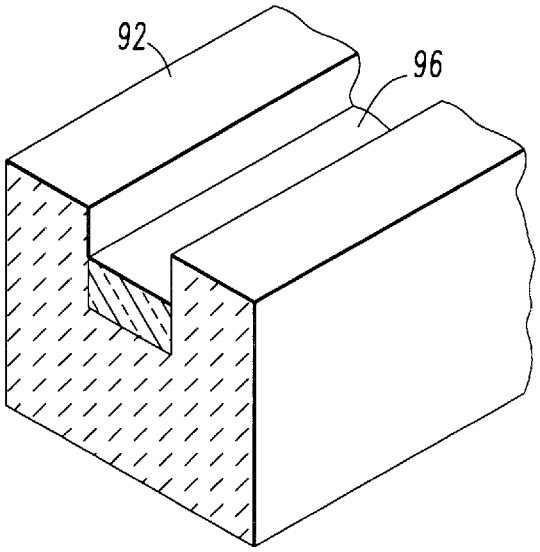
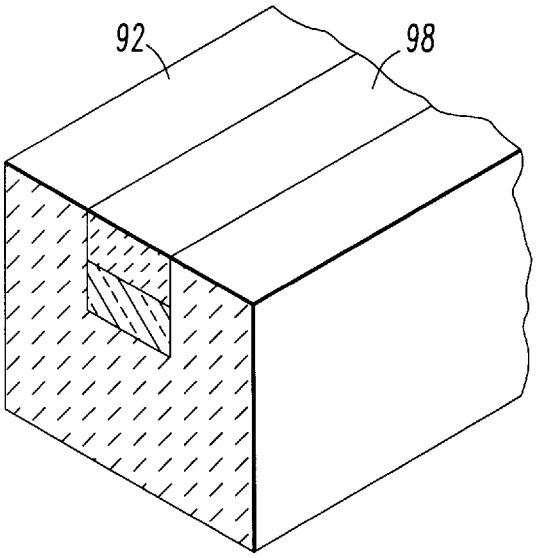
FIG.5c
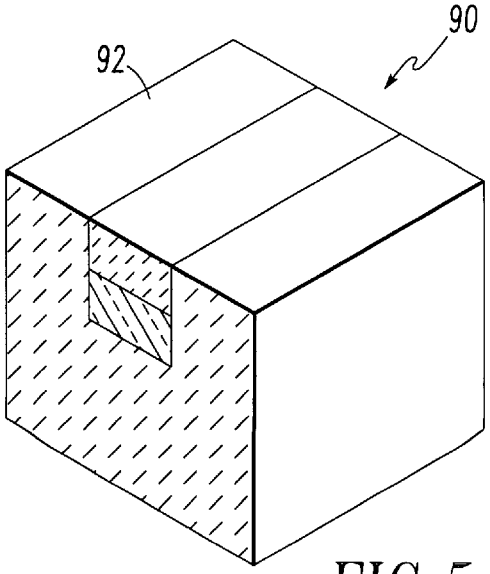
FIG.5d

FIG.6a
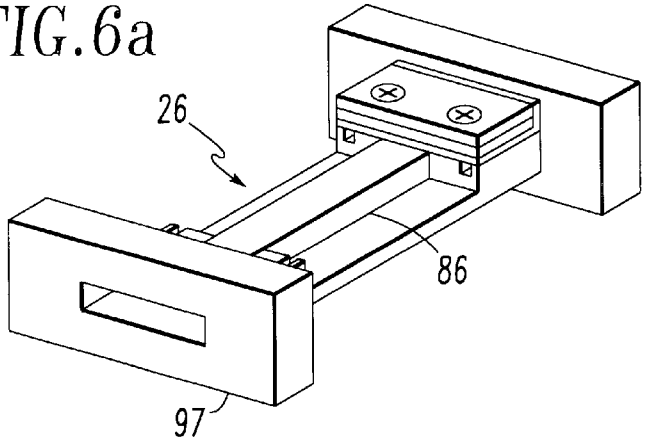
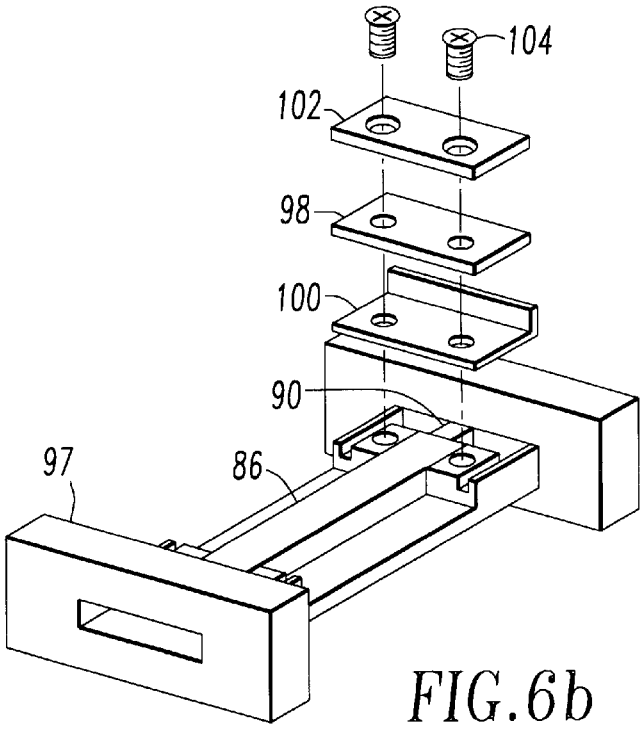
FIG.6b
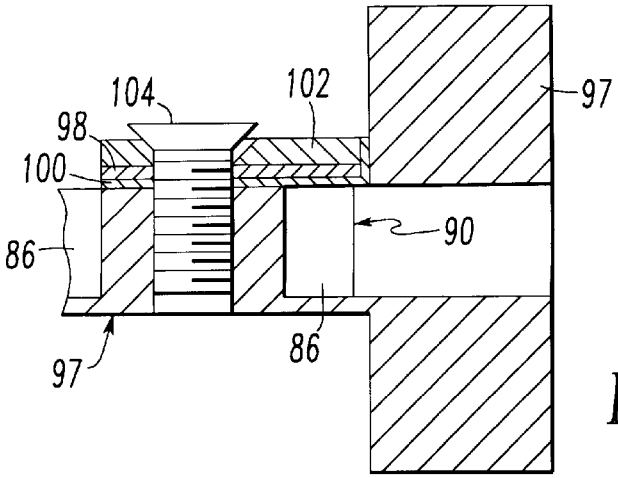
FIG.6c

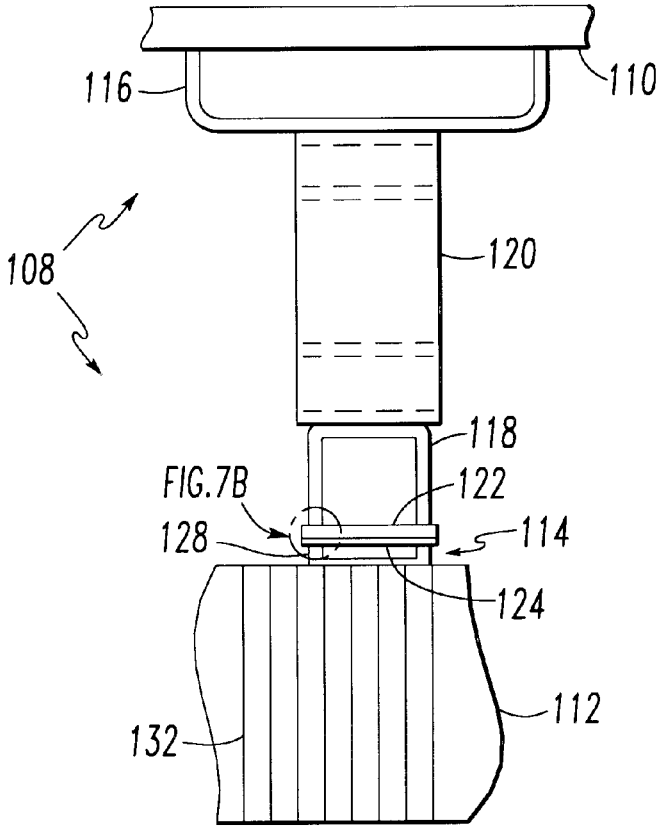
FIG.7a
FIG.7b
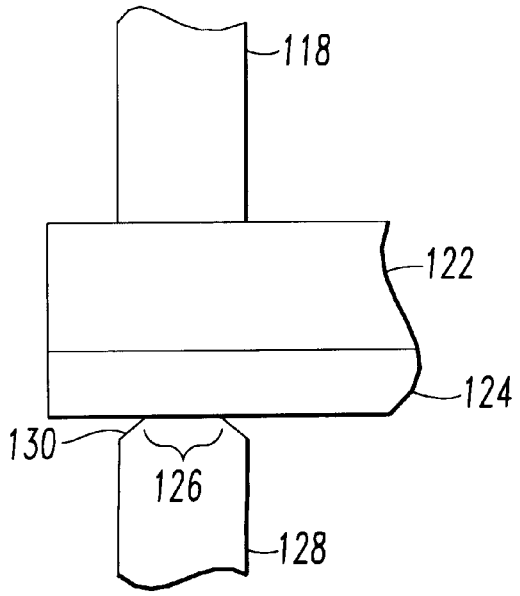

FIG.8
PRIOR ART
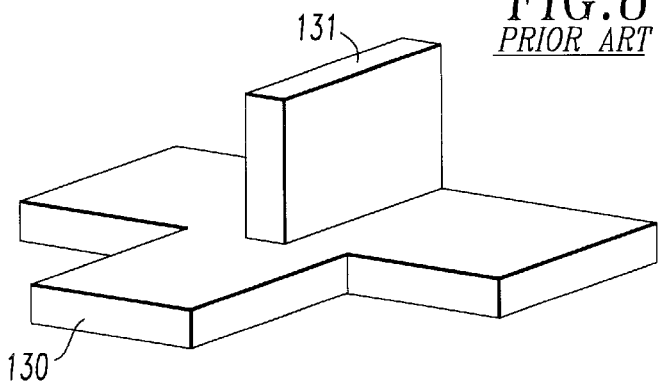
FIG.9a
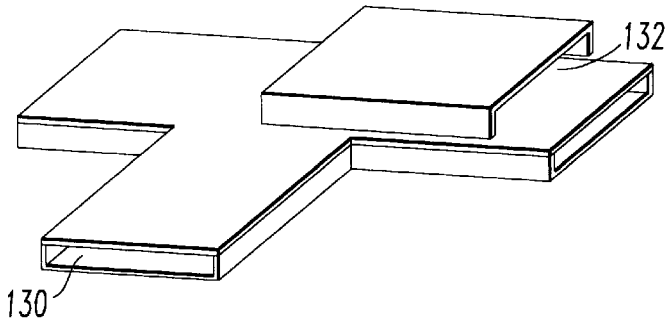
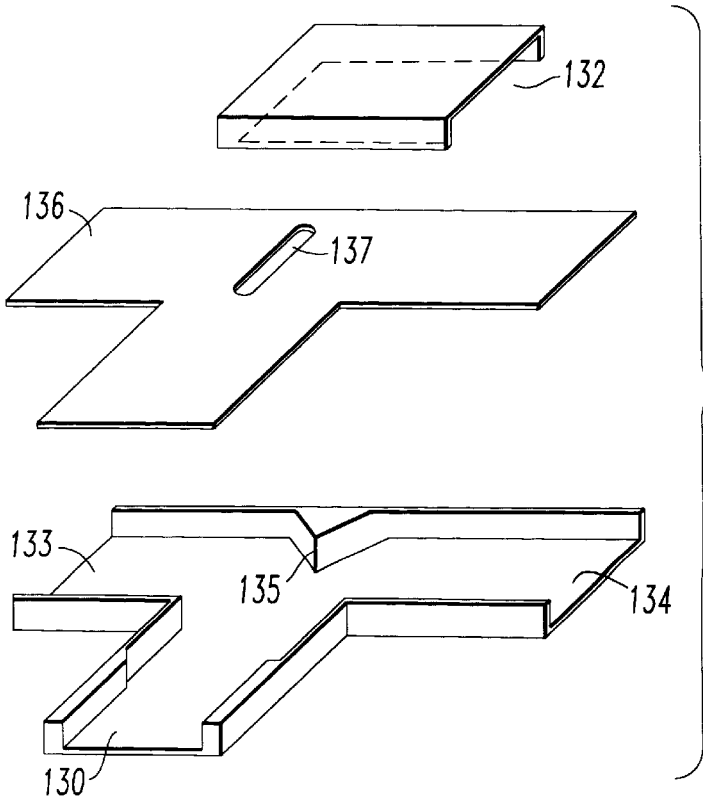
FIG.9b

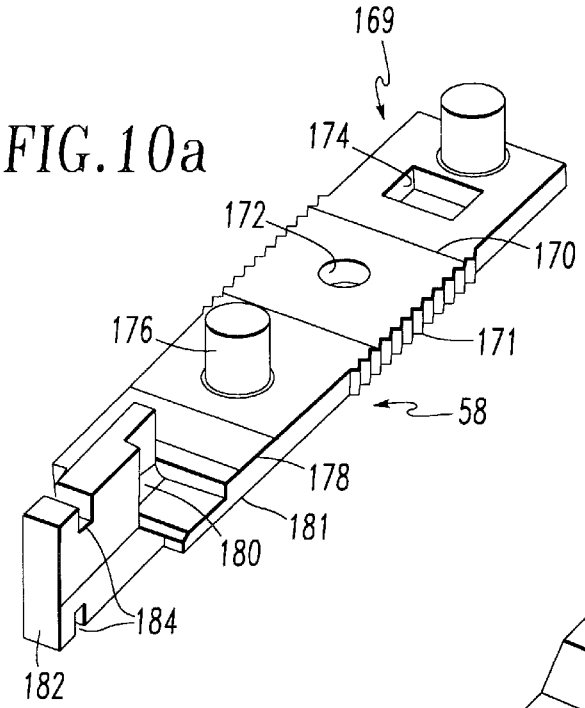
FIG.10a
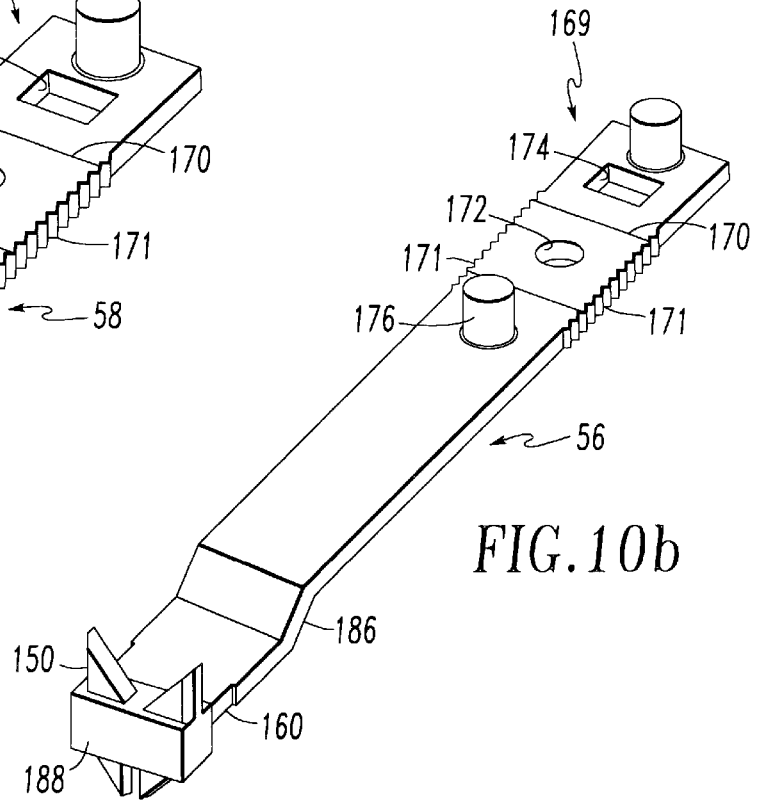
FIG.10b
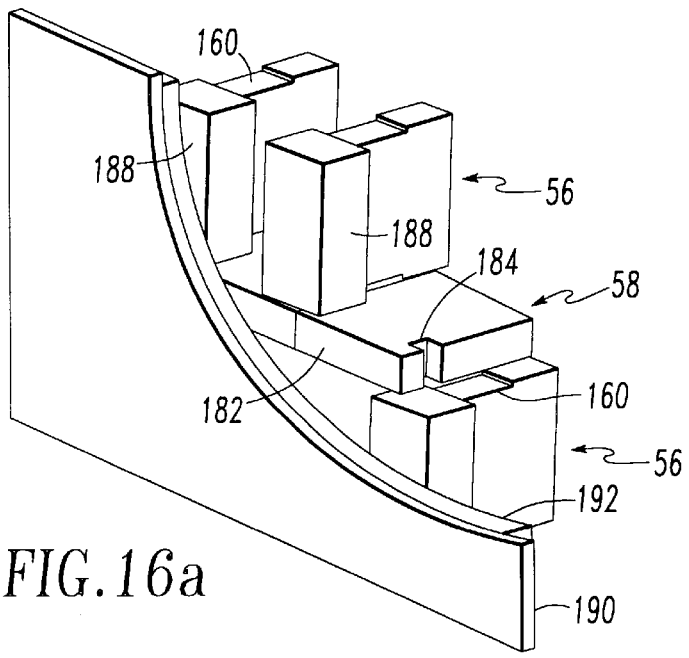
FIG.16a
FIG.16b
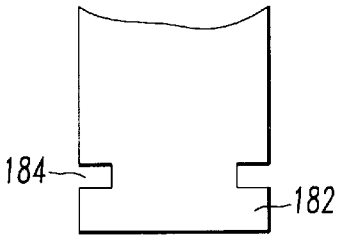
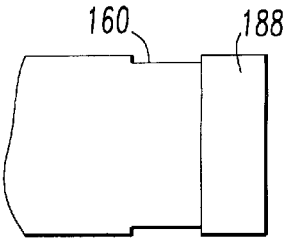
FIG.16c

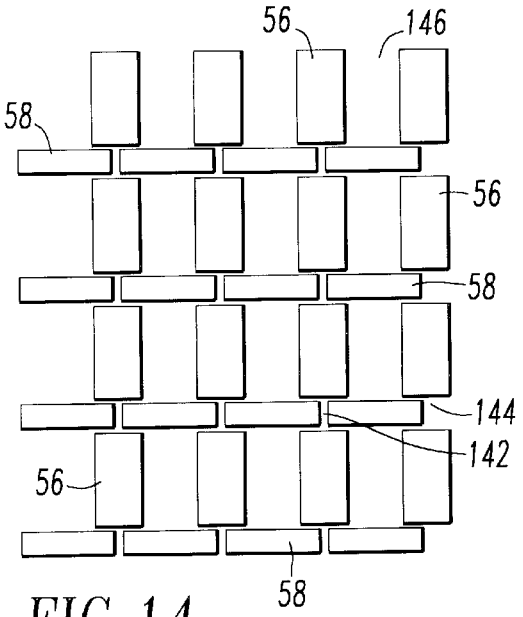
FIG.14
FIG.15a
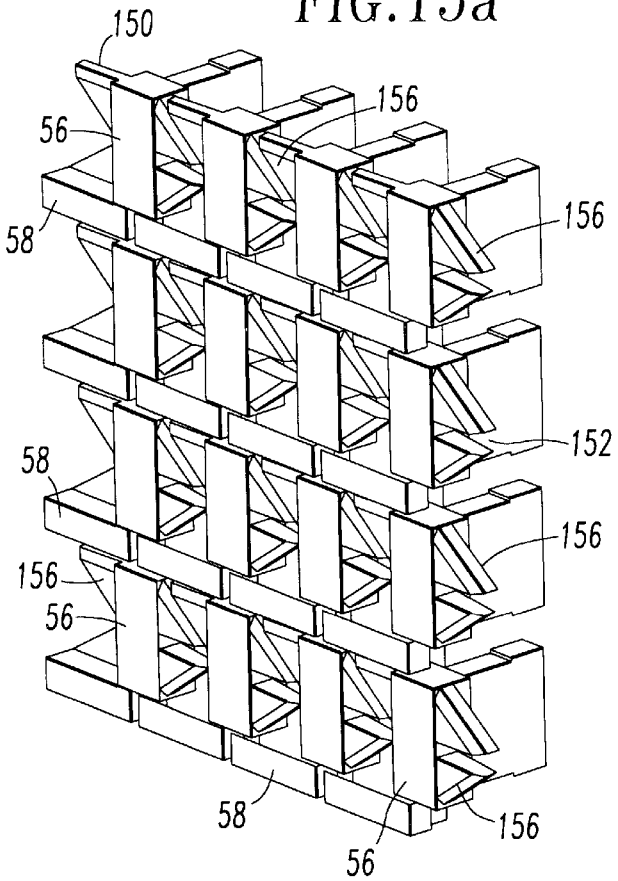
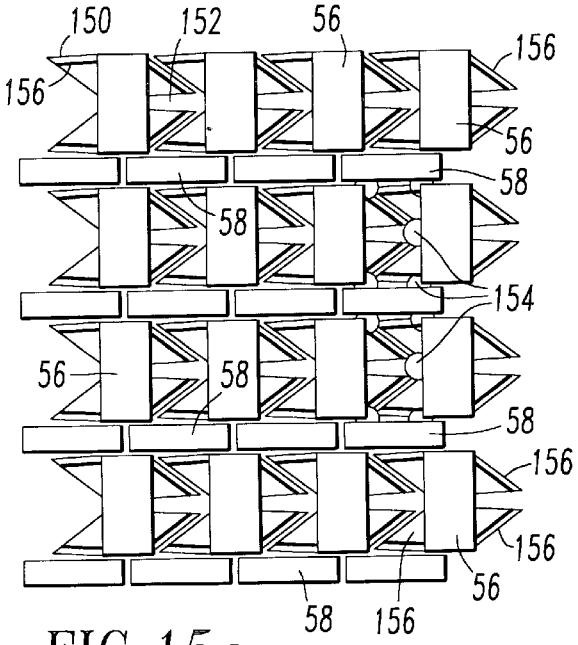
FIG.15c
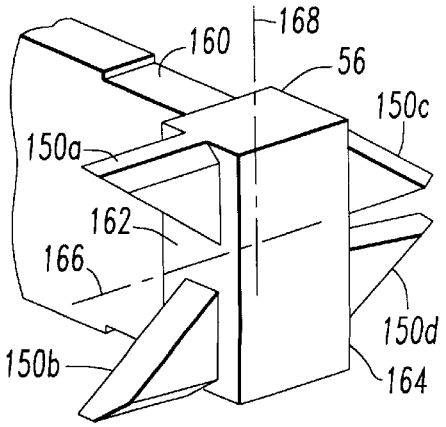
FIG.15B

DUAL POLARIZED ELECTRONICALLY SCANNED ANTENNA

CROSS REFERENCE TO RELATED APPLICATIONS

This application claims priority under 35 U.S.C. §119(e) to U.S. Provisional Application No.: 60/032,707 filed Dec. 12, 1996.

BACKGROUND OF THE INVENTION

1. Field of the Invention

The present invention is directed to a dual polarized, single axis, electronically scanned antenna. In particular, the present invention is directed to a lightweight, compact antenna system, which utilizes two independent orthogonally polarized antennas with congruent patterns that occupy virtually the same space and can be electronically scanned over wide angles.

2. Description of Problem

A phased array antenna is composed of a group of individual radiators which are distributed and oriented in a linear or two dimensional configuration. The amplitude and phase excitations of each radiator can be individually controlled to form a radiated beam of any desired shape. The position of the beam is controlled electronically by adjusting the phase of the excitation signals at the individual radiators.

The capability of rapid and accurate beam scanning permits the radar to perform multiple functions. One such function is the detection of a number of targets. Man-made objects reflect electromagnetic energy quite differently than naturally occurring objects. This phenomenon can be observed in radar systems that utilize polarization techniques and their measurement methods. Information from this method can be used to identify the type of target that has been observed. The radar for use in such methods, however, requires a low side-lobe antenna capable of measuring orthogonally polarized return simultaneously and independently. In addition, the antenna patterns of the two polarized returns must be congruent over all angles. An antenna meeting these requirements has not previously been known.

SUMMARY OF THE INVENTION

It is therefore an object of the present invention to provide a low sidelobe antenna meeting the above requirements. In particular, such a low side lobe antenna may be achieved by providing a number of small radiating elements closely together and collecting their signals coherently into a single signal. This is known as a phased array. In order to produce a single main beam from a phased array at broadside, the spacing of the radiating elements must be less than a wavelength. For electronically scanned antennas, the spacing must be close to half of the wavelength. At millimeter wave frequencies in the Ka band, the requirement is that the elements be spaced within 0.2" of each other. The need for congruent patterns of the two independent polarized antennas require that the antennas occupy virtually the same space. In accordance with the present invention, this can be accomplished by choosing radiating elements that can be offset and fit within the spaces left by the adjoining orthogonally polarized antenna. Thus, the apertures of the two antennas occupy virtually the same space.

It is a further object of the present invention to provide an antenna which can collect a complete polarization matrix with two pulse transmissions. This can be achieved in the present invention by simultaneously receiving both polarizations, while alternating transmission of these polarizations. This polarization information can then be used to make judgements of other types of stationary object being observed.

It is yet another object of the present invention to provide an antenna which is compact, low cost, and lightweight in overall design. The features are desirable in allowing the configuration to be flexible enough such that it can be easily adapted and mounted on a variety of platforms.

These and other objects of the present invention will become more readily apparent from detailed description given hereinafter. However, it should be understood that the detailed description and specific examples, while indicating the preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3*a* is an exploded view of the twist for the twist plate in FIG. 1*a;*

FIGS. 3*b* and 3*c* are alternative configurations for implementing the twist in FIG. 3*a;*

FIG. 4*a* is a view of how the individual laminate layers for the toroidal phase shifter are stacked before lamination;

FIGS. 5*a*–5*d* illustrate a method of making a matching transition of the present invention for use with the phase shifter;

FIG. 6*a* is a perspective view of the phase shifter assembly of the present inventions;

FIG. 6*b* is a partially exploded view of the phase shifter assembly in FIG. 6*a;*

FIG. 6*c* is a cross section of the phase shifter assembly in FIG. 6*a;*

FIG. 7*a* illustrates the precision forming of a manifold of the present invention;

FIG. 7*b* is a detailed portion of the circled region in FIG. 7*a;*

FIG. 8 is a perspective view of a conventional magic tee;

FIG. 9*a* is a perspective view of the magic tee of the present invention;

FIG. 9*b* is an exploded view of the magic tee in FIG. 9*a;*

FIG. 10*a* is a perspective view of a vertically polarized radiator of the present invention;

FIG. 10*b* is a perspective view of a horizontally polarized radiator of the present invention;

FIG. 14 is a front view of an array radiator grid;

FIG. 15*a* is a perspective view of the array radiator grid in FIG. 14 with the ground plane of the present invention integrated therewith;

FIG. 15*b* is a perspective view of an individual horizontally polarized radiator containing the integrated features of the ground plane of the present invention;

FIG. 15*c* is a front view of the integrated ground plane in FIG. 15*a;*

FIG. 16*a* is a perspective view of the integrated ground plane of FIG. 15*a* further integrated with a matching sheet;

FIG. 16*b* is a side view of the impedance matching features on the vertically polarized radiator in FIG. 15*a*; and FIG. 16*c* is a side view of the impedance matching features on the horizontally polarized radiator in FIG. 15*a*.

DETAILED DESCRIPTION OF THE PREFERRED EMBODIMENTS

Figure 1A:
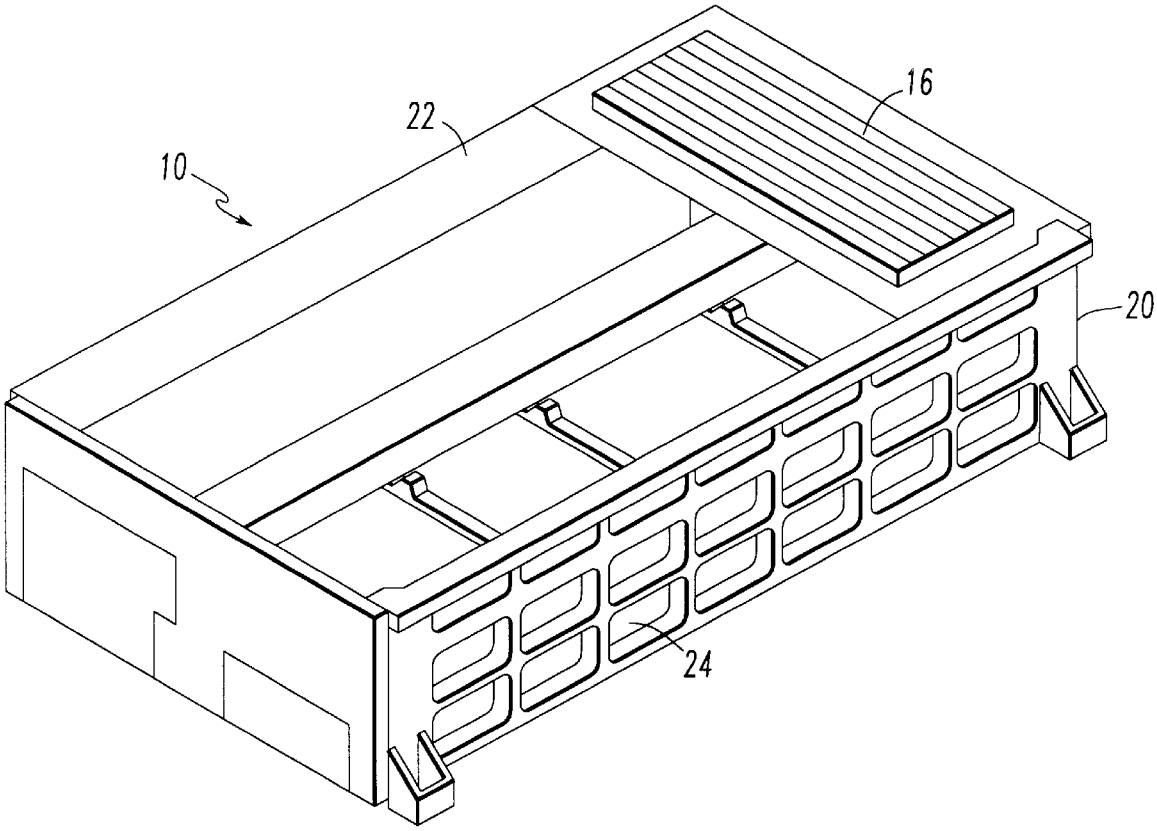
FIG. 1*a* is a perspective view of the overall antenna assembly of the present invention.

An antenna array assembly 10 is shown generally in FIG. 1*a*. In order to eliminate side lobes, the antenna may be achieved by providing a number of small radiating elements closely together and collecting their signals coherently into a single signal. This is known as a phased array. In order to produce a single main beam from a phased array at broadside, the spacing of the radiating elements must be less than a wavelength. For electronically scanned antennas, the spacing must be close to half of the wavelength. At millimeter wave frequencies in the Ka band, the requirement is that the elements be spaced within 0.2" of each other. The need for congruent patterns of the two independent polarized antennas require that the antennas occupy virtually the same space.

Due to space constraints noted above, radiating elements must be chosen which can be offset and fit within the spaces left by the adjoining orthogonally polarized antenna. Thus, the apertures of the two antennas occupy virtually the same space. Thus, the antenna assembly 10 of the present invention includes a vertical waveguide assembly 12 and a horizontal waveguide assembly 14, shown in FIG. 2*a*. The vertical waveguide assembly 12 includes a vertical elevation manifold 13 or air waveguides having couplers, and vertically polarized radiators 58 which cannot be seen in this view. The horizontal waveguide assembly 14 includes a horizontal elevation manifold 15 and horizontally polarized radiators 56.

The vertically polarized radiation of the vertical waveguide assembly 12 does not interfere with the horizontally polarized radiation of the horizontal waveguide assembly 14. During transmission, these assemblies are used alternately. However, these assemblies simultaneously receive signals.

In making these assemblies congruent, the vertical and horizontal waveguide assemblies are mated together to form a mated assembly 16. A plurality of these mated assemblies 16 are mounted in an antenna housing 20. The antenna housing 20 shown in FIG. 1*a* has covers thereof removed for purposes of illustration.

Figure 1B:
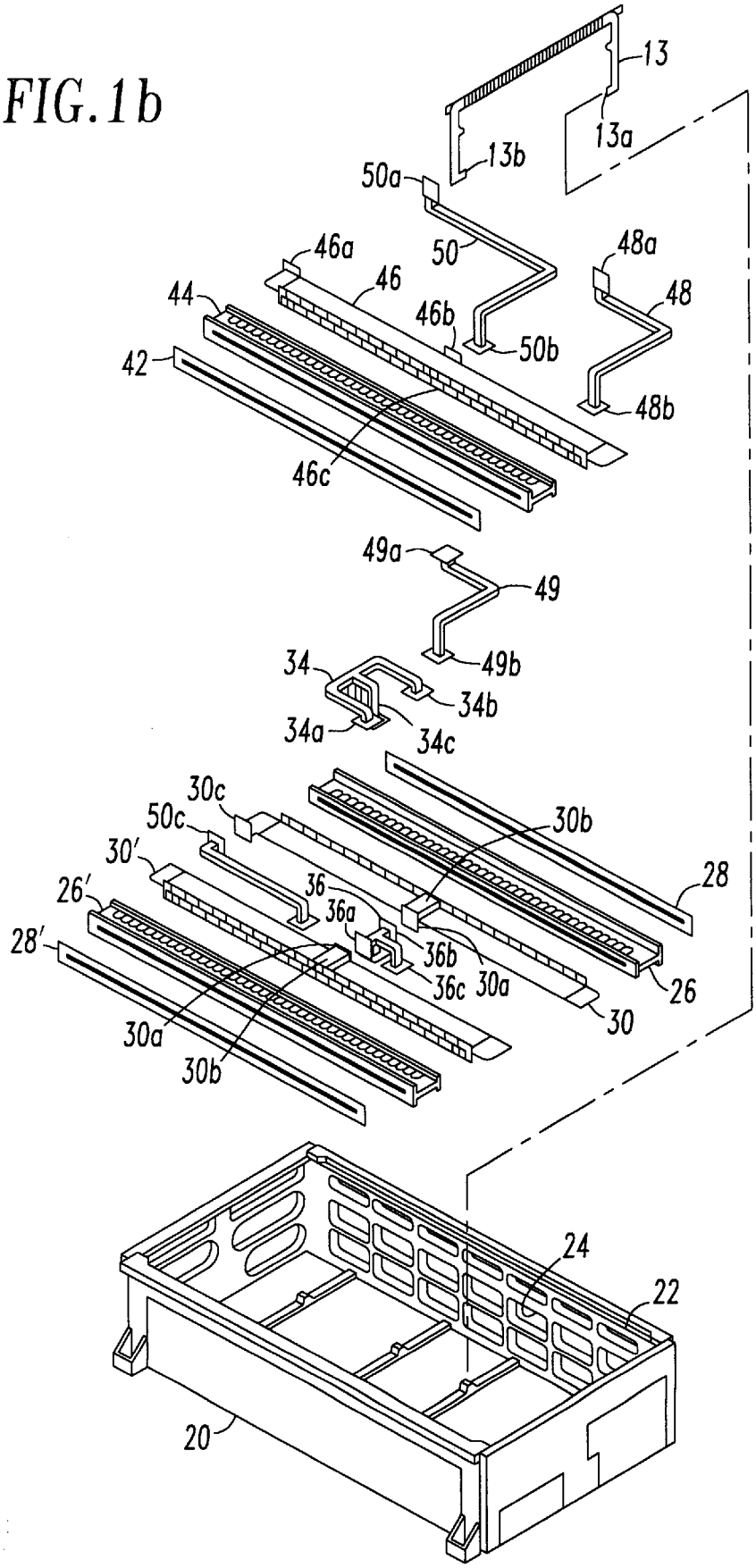
FIG. 1*b* is an exploded view of the assembly shown in FIG. 1*a;*

An exploded view of the array assembly 10 is shown in FIG. 1*b*. The antenna housing 20 includes holes 22 for mounting the mated assembly 16. Optionally, slots 24 may be provided for making the housing 20 lighter in weight be eliminating the material of the housing therefrom.

A phase shifter assembly 26 includes multiple elements for scanning the antenna array 10. The signal from the phase shifter assembly is delivered to a twist plate 28. The other side of the phase shifter assembly 26 is adjacent to a first vertical azimuth manifold assembly 30 from which the phase shifter assembly 26 receives a signal. A mirror image of the same structure is mounted opposite, with the vertical azimuth manifold assemblies 30, 30' facing each other, each followed by the phase shift waveguides 26, 26' and the twist plates 28, 28'. These mirror image assemblies are connected by a magic tee 36 which splits the manifolds in half to form a vertical azimuth assembly.

The horizontal azimuth assembly is situated above the vertical azimuth assembly. The horizontal azimuth assembly includes a twist plate 42, a phase shifter assembly 44 and a horizontal azimuth manifold 46. The horizontal azimuth assembly also includes a sum port 48, a calibration port 50 and a difference port 49.

Figure 1C:
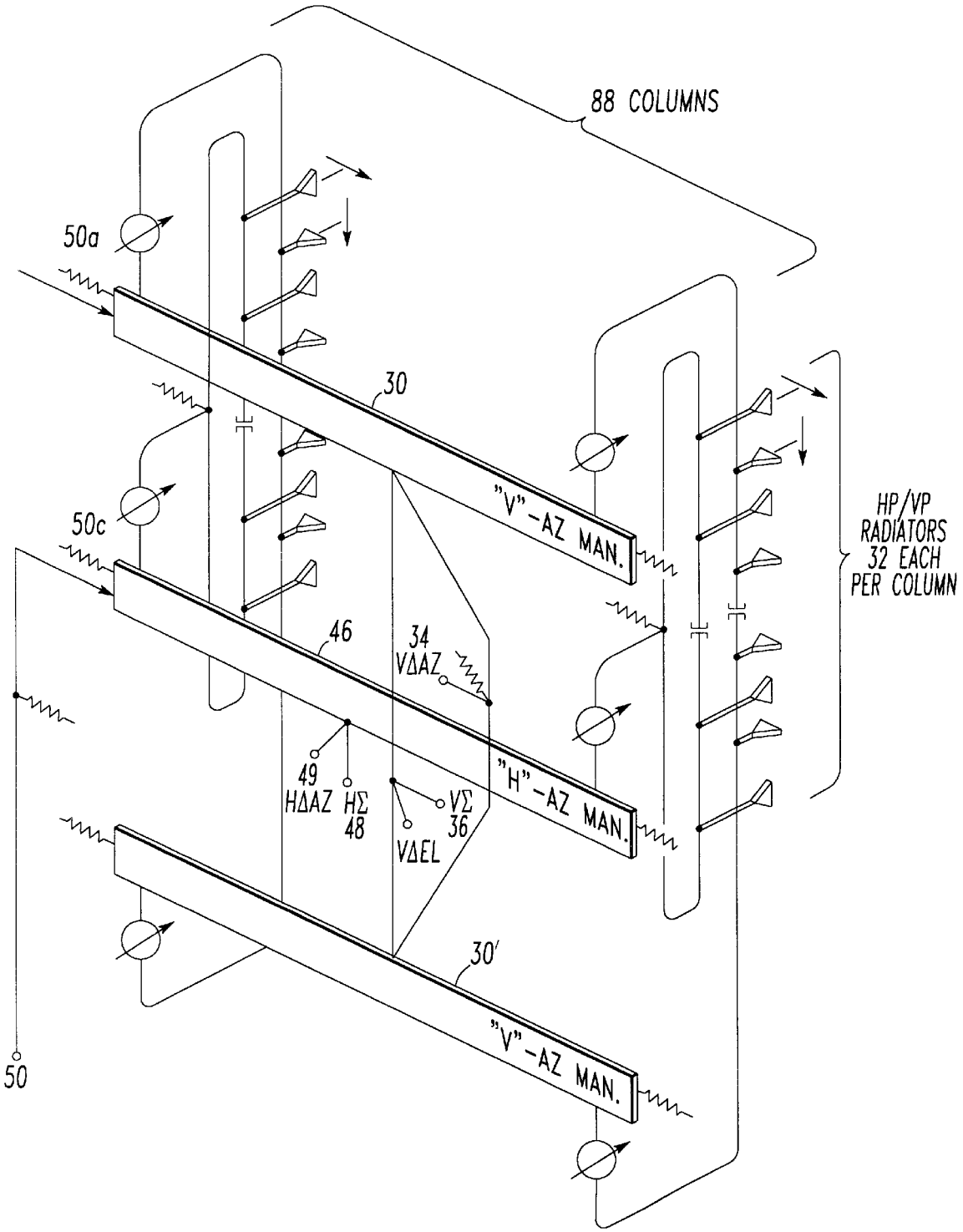
FIG. 1*c* is a schematic illustrating the relationship between the ports, the azimuth and elevation manifolds and the radiators.

The RF energy comes into the antenna via six (6) waveguide channels, which can be most easily seen in the schematic of FIG. 1*c*. These RF signal paths include a vertical sum, a horizontal sum, a vertical delta azimuth, a horizontal delta azimuth, a vertical delta elevation, and a vertical and horizontal calibration channel. These pieces of waveguide are center fed to three (3) different traveling waves series fed manifolds 30, 30' and 46. Utilizing cross-guide couplers, the manifolds split the RF signal multiple ways depending on the azimuth size of the antenna.

These ports are also shown in FIG. 1*b*. The calibration waveguide includes a port 50*a* connected to a port 46*a* on the horizontal azimuth manifold 46, and a port 50*c*, connected, via a port 50*b* to a port 30*c* on the vertical azimuth manifold 30. Only one calibration port is needed for the two vertical azimuth manifolds 30, 30', since they are interconnected.

A horizontal azimuth sum waveguide 48 includes a port 48*a* connected to a port 46*b* on the side of the horizontal azimuth manifold 46. A port 48*b* connects provides the horizontal azimuth sum to the antenna. A horizontal azimuth difference or delta waveguide 49 includes a port 49*a* connected to a port 46*c* on the underneath of the horizontal azimuth manifold 46 and a port 49*b* delivers the horizontal azimuth difference to the antenna.

The vertical azimuth difference waveguide 34 includes a port 34*a* connected to a port 30'*b* on the vertical azimuth manifold 30', a port 34*b* connected to a port 30*b* on the vertical azimuth manifold 30, and a port 34*c* providing the vertical azimuth difference to the antenna. Finally, the magic tee 36 includes a port 36*a* connected to a port 30'*a* on the vertical azimuth manifold 30', a port 36*b* connected to a port 30*a* on the vertical azimuth manifold 30, and a port 36*c* for delivering the vertical azimuth sum to the antenna. The ports 36*a* and 36*b* also serve to connect the vertical elevation difference to the antenna through the manifold through the ports 13*a* and 13*b* on the elevation assembly.

In the specific example shown in FIGS. 1*b* and 1*c*, the vertical azimuth manifolds 30, 30' form a monopulse such that a sum and a difference response are generated simultaneously for each the vertically polarized waveguides. Alternatively, the horizontal azimuth manifold 46 could also provide a monopulse as the vertical azimuth manifolds do by providing an additional horizontal azimuth manifold and associated elements which are interconnected. For observing stationary targets, as is an important application of the present invention, the horizontal elevation does not need to be monopulse.

Figure 2A:
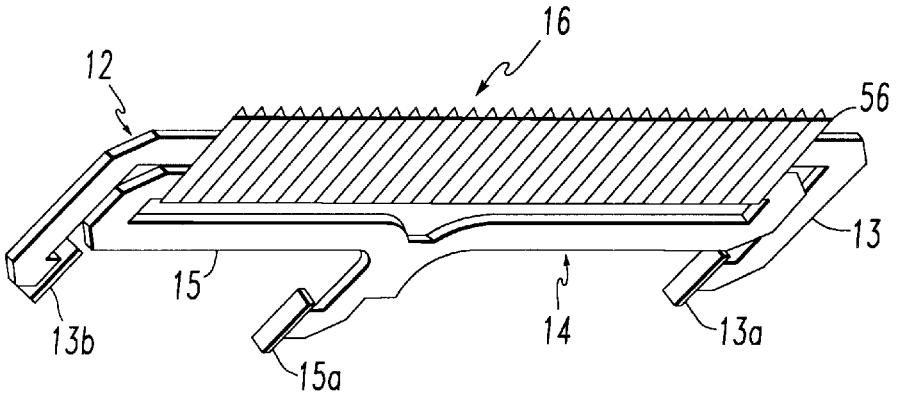
FIG. 2*a* is a perspective view of the horizontal and vertical elevation waveguide assemblies mated together.
Figure 2B:
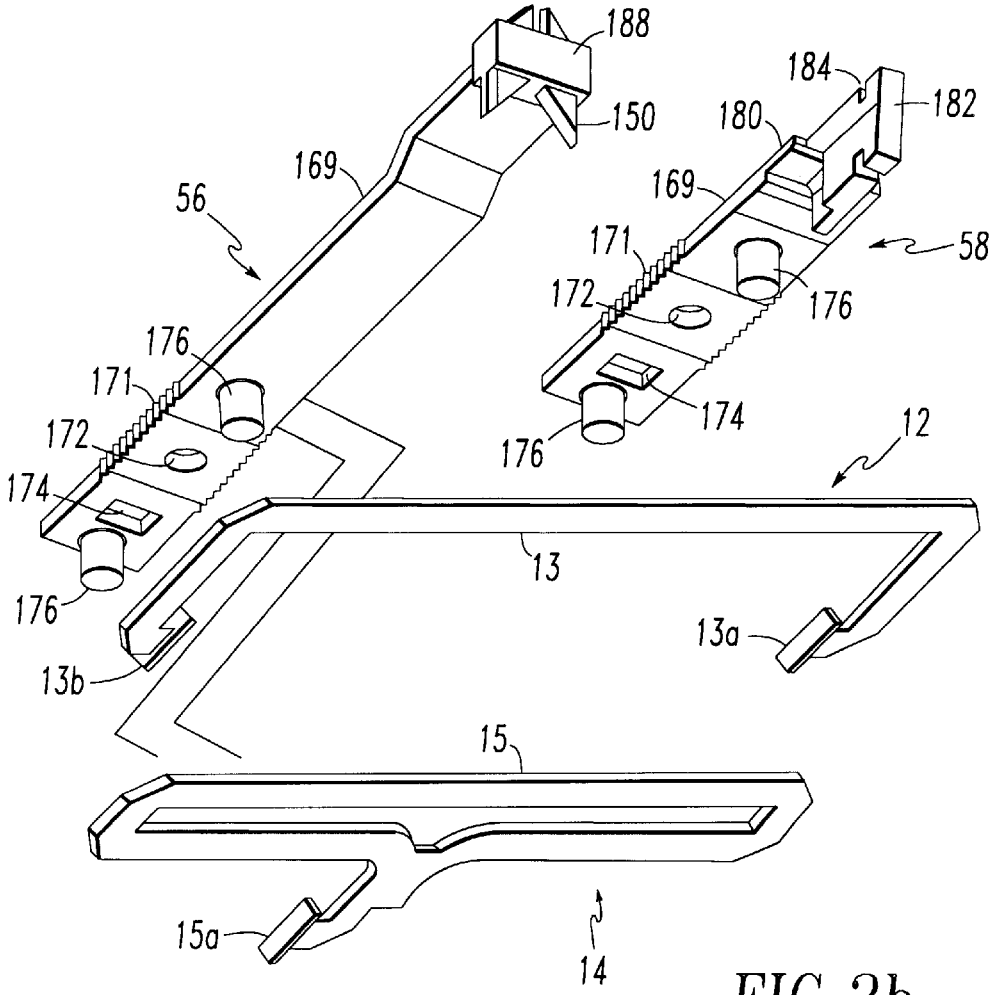
FIG. 2*b* is an exploded and detailed view of the mated waveguide assembly shown in FIG. 2*a;*

The signals leaving the manifolds 30, 30', 46 flow into the phase shifter assemblies 26, 26', 44, respectively. The phase shifter assemblies 26, 26', 44 consist of multiple elements and preferably utilize toroidal phase shifters. The signal leaving the phase shifter assembly travels through the twist plates 28, 28', 42, respectively, which turn and orient the waveguide 90° such that it can interface with the vertical and horizontal "sticks." The waveguide sticks, shown in FIGS. 2*a* and 2*b* are small precise pieces of waveguide which must carefully machined in order to function, as discussed later. The energy flowing into the horizontal and vertical sticks is then coupled to horizontal and vertical dielectric radiators shown in FIG. 14.

As noted above regarding FIGS. 2*a* and 2*b*, the vertical and horizontal waveguide assemblies include the respective horizontal and vertical elevation manifold or air waveguide and coupler. Only a single vertical elevation manifold 12 is shown in the exploded view of FIG. 1*b*. While the entire azimuth manifold assemblies are shown in FIG. 1*b*, since they extend along the length of the antenna housing 20, the plurality of elevation manifold assemblies mounted orthogonally to the azimuth manifold assemblies are not shown. The elevation assembly itself is illustrated in FIGS. 2*a* and 2*b*, and a plurality of these elevation assemblies will be connected to their respective azimuth assemblies as follows.

As can be seen in FIG. 1*b*, the vertical elevation manifold 13 is connected via couplers 13*a*, 13*b* to the vertical azimuth manifolds 30, 30' through the corresponding twist plates 28, 28'. In other words, the vertical elevation manifold is mounted across the vertical azimuth manifold. Similarly, the horizontal elevation manifold 15 is connected via a coupler 15*a* to the horizontal azimuth manifold 46 through the twist plate 42.

A schematic of the manifolds and radiators is shown in FIG. 1*c* . As can be seen therein, the vertical radiators are controlled by the vertical azimuth manifolds, while the horizontal radiators, in this specific example, only require a single azimuth manifold. In the specific configuration shown in FIG. 2*b*, there are 88 columns of radiators and each column has 32 each of horizontal and vertical radiators. The connection of the calibration channel to the manifolds is also shown.

Details of the elements of the array are discussed below. These elements were all designed to realize a practical implementation of the desired congruent dual polarized antenna array of the present invention.

Vertical Radiator Compact Waveguide Twist

FIGS. 3*a*–3*c* illustrate the compact waveguide twist plate 28, 28', 42 of the present invention. The compact waveguide twist includes a twist region 60 which essentially includes a double ridged waveguide where the ridge is rotated 45° with respect to the incoming and outgoing waveguides 62, 64, respectively. These waveguides could be either the horizontal or vertical azimuth being connected to the horizontal or vertical elevation, respectively.

Each of the sidewalls of the ridge waveguide section are split into two paths which extend across the two (2) orthogonal waveguides in a symmetric manner. This region acts as an impedance matching structure and a polarization twisting mechanism. The twist structure is of a constant cross-section and extends approximately one quarter of a wavelength deep. The ridge section can be a 45° chamfer as shown in FIG. 3*c* or rounded as shown in FIG. 3*b* depending on the method of manufacture.

A benefit of the twist shown in FIG. 3*a* is that no swept volume is required beyond the intersection of the twisted waveguides. This allows for use of the twist in applications where radiators and phase shifters are densely packed together. Previous twist designs limited the radiator packing density because of the requirement of a tuning cavity which extends beyond the twisting waveguides plane of interception.

While the above description applies to a 90° twist with a quarter wavelength height, the concept is applicable to any twist ranging from 0° to 90° and is suitable for waveguides of various heights.

Ferrite Toroid Fabrication

Phase shifters are high volume components in a phased array radar system and can be implemented in a variety of ways depending on the requirements of a given application. Twin toroidal phase shifters have been developed specifically to meet the requirements of most waveguide applications. A twin toroidal phase shifting element consists of a thin, high dielectric center rib sandwiched between two (2) ferrite toroids. The toroidal phase shifter is sometime called a twin slab device since phase shift is provided by the vertical toroid branches, i.e., parallel to the E field, while the horizontal branches are used to complete the magnetic circuit.

Toroidal phase shifters are commonly used in waveguide applications where power levels exceed 0.1 Watt and low insertion loss is important. A figure of merit (FOM) of interest for a toroidal phase shifter is phase shift per unit of insertion loss. Conventionally, separate pieces are machined and then bonded together to form a two stage transition. This requires high machining tolerances and individual tuning of the input and output match of each phase shifter.

Ferrite phase shifters are used in electronically scanned radar arrays. The most costly part in the fabrication of the phase shifters is the fabrication of ferrite toroids. Traditionally, the fabrication of the toroids is through either powders which are poured into dyes and pressed into shape around a rectangular mandrel or through a plastic that can be extruded. The dimensions of the through hole are established during pressing or extruding. Both resulting bars must be redimensioned and reshaped after firing to make achieve final outside dimensions. This is achieved by cutting and grinding while maintaining close tolerances, resulting in high tool and labor costs.

In contrast, the present invention forms toroids using tape of ceramic oxides. As noted above, the long square shaped through holes required by the toroid design still need to be maintained during the firing process. However, the fabrication in accordance with the present invention does not require post firing machining. FIG. 4*a* shows the process required for fabrication of toroids using tape technology in accordance with the present invention. A core laminate 70 is sandwiched between a top laminate 72 and a bottom laminate 74. Laminates are made by pre-laminating a select number of ferrite layers as determined by the toroid design. Alignment holes 75 are drilled in each of the laminates.

Parallel slots or cavities 71 of predetermined dimensions are then drilled or routed in the core laminate 70 using a router. Since these slots 71 are formed in the same piece of material, they will already have nearly the same thickness, thus only two dimensions need to be controlled. Thus, the routing of these slots 71 is much simpler than the previous creation of the square through holes.

Since the resulting core laminate 70 will have a reduced area compared to the top laminate 72 and the bottom laminate 74, the pressure at which the core laminate 70 is pre-laminated will be varied from that for the top and bottom laminates. This is so that during the final lamination, when all three laminates are simultaneously subjected to a low pressure merely for their integration, the laminates will contract and expand at the same rate to achieve the desired final dimensions.

The core laminate 70 is then placed between the top 72 and bottom laminates 74 using the alignment holes 75 thereon each of these laminates. An alignment sheet 76, containing alignment pins 78 to be received by the alignment holes 75 in each of the laminates is used to insure alignment. The resulting structure is then put in a laminating fixture and subjected to isostatic or uniaxial pressing.

During lamination, pressure is applied in such a way that the three laminates are well pressed into one part without any delamination, shape distortion of the whole configuration, collapsing or buckling of the through holes. This is achieved by optimizing pressure, temperature and the hold time of the lamination.

After lamination, the alignment holes and ends are routed off, the alignment sheet is removed, and the parts are fired using the standard firing profile to obtain a toroid sheet.

Figures 4B, 4C, 4D, 4E:
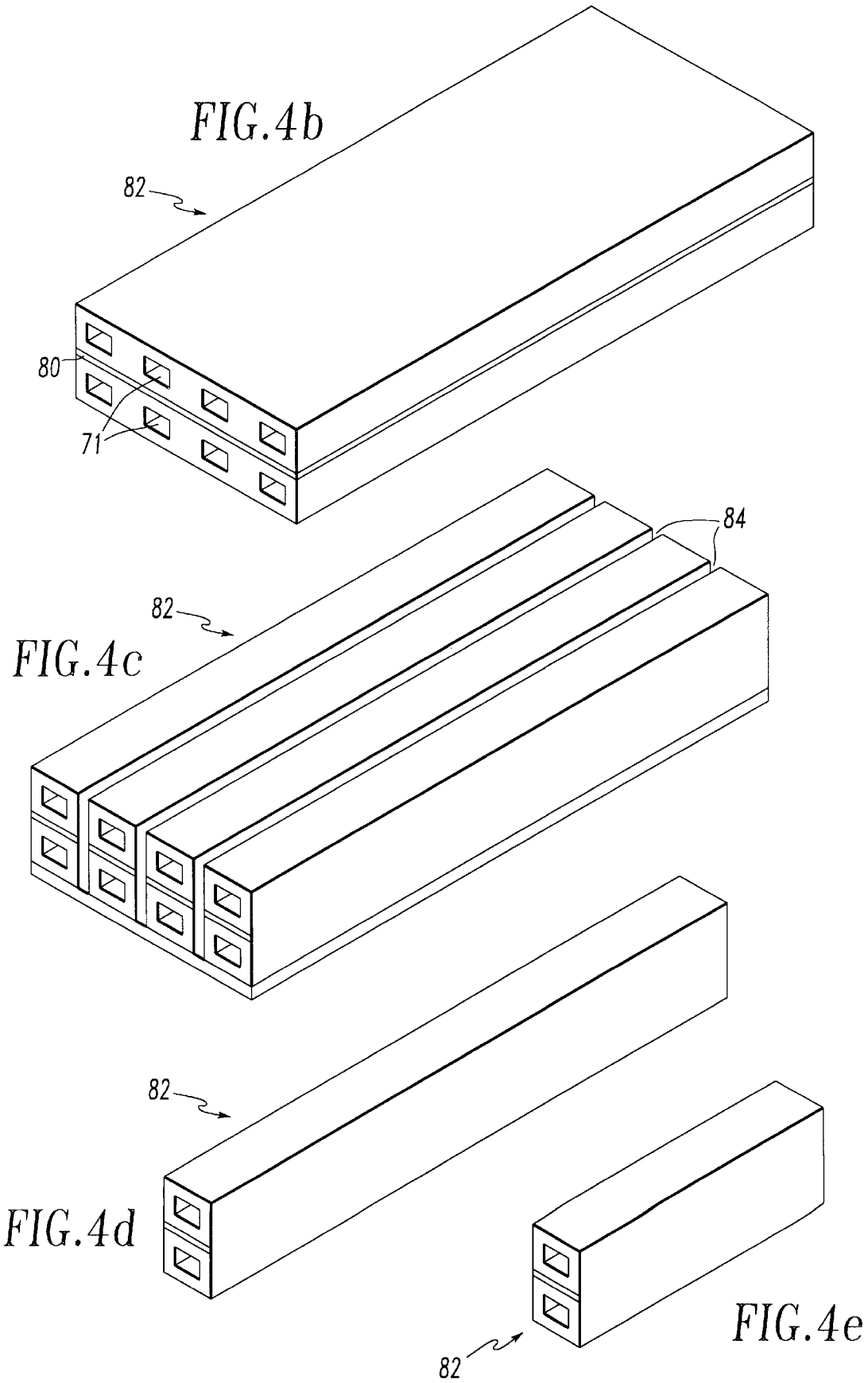
FIGS. 4*b*–4*e* illustrate various steps for obtaining a twin toroid of a desired length from a composite of a dielectric sandwiched between a pair of laminates.

Finally, a dielectric sheet is bonded between the two toroid sheets as shown in FIG. 4*b*. Preferably, preform bonding using, for example, 0.0005" Teflon preform manufactured by E. I. duPont deNumers Corp. Teflon offers lower RF loss and very high temperature resilience. The top and bottom surfaces are then plated with metal such as copper. The composite structure 82 is then grooved lengthwise between the through holes as shown in FIG. 4*b* to create grooves 84 shown in FIG. 4*c*. A second plating may be performed to cover the other two sides exposed by the grooving with metal.

The composite structure 82 is then sliced lengthwise through the grooves 84 to separate into composites of only two through holes as shown in FIG. 4*d*. This separated structure is then diced as to a desired length to obtain a toroid pair shown in FIG. 4*e*. Depending on the dimension of the toroid sheet, a large number of toroid pairs can be built from the same sheet. This is in clear contrast with the conventional fabrication techniques for which each toroid pair must be built individually.

Further, the fabrication technique of the present invention results in significant reduction in post fired machining labor and tooling, and in center rib bonding labor and tooling. The fabrication of the present invention readily permits the use of preform adhesives when bonding center rib material between ferrite laminates. Previously, liquid based epoxies had been used because fixturing for preforms is too costly for the relatively small size of a Ka band phase shifter. Preforms save labor while yielding a more uniform and repeatable bond line, thereby reducing performance variability.

Phase Shifter Transitions

An efficient phase shifter design is optimized to provide the required amount of phase shift while minimizing insertion loss. Once a twin toroid 86 design has been optimized for phase shift and insertion loss, the matching transition 90 must be designed. The purpose of the matching transition is to ensure that the phase shifter has a low return loss across the frequency band of interest. If the matching transition is not designed and implemented properly, the optimized insertion loss of a phase shifting element will be undermined by mismatch losses.

FIGS. 5*a*–5*d* illustrate a method for fabricating a multistage matching transistor for use with the above toroidal phase shifter in the phase shifter assembly of the present invention. The first step in the fabrication process, shown in FIG. 5*a*, involves machining a channel 94 into a piece of low dielectric material 92, for example, rexolite (E=2.5). By choosing a material with a lower dielectric constant, the tolerance requirements on the outside dimension of the final matching transition are reduced. The dimensions of the matching transition are chosen to meet the requirements of a given application. The overall length of the channelized stock is not critical and will typically be chosen to yield approximately 100 matching transitions.

The second and third steps, as shown in FIGS. 5*b* and 5*c*, involve filling the channel 94 with a dielectrically loaded resin. Such a suitable resin would be Epon 828 or Epon 815 manufactured by Shell Chemical Corporation.

The specific example shown in FIGS. 5*b* and 5*c* depicts the channel 94 being filled with two (2) different dielectric layers, 96, 98. In practice, the channel 92 could be filled with any number of dielectric layers, but a satisfactory matching transition can be achieved if the channel 92 is filled with only one dielectric layer. An advantage of filling the channel 92 with multiple layers would be to allow for the creation of a dielectric gradient within the matching transitions 90. The ability to incorporate a dielectric gradient into a matching transition 90 design represents a new design parameter not previously available. Due to this additional design parameter, matching transitions with improved electrical performance and reduced dimensional tolerancing requirements can be designed.

The final step shown in 5*d* involves "dicing" the channelized stock into individual phase shifter matching transitions 90. The dimension established by this final dicing operation represents the height of the matching transition 90. The height of the matching transition is typically equal to the height of the mating dual toroid shown in FIG. 4*e*. Normally, a very small height differential between the toroid and the matching transition 90 would significantly degrade the electrical performance of the phase shifter. However, by accommodation of height differentials discussed in the following section, the machining tolerances required to establish the height of the matching transitions 90 are well over the achievable limits for applications up to at least 40 GHz.

Alternatively, the channel 92 could be filled with a solid dielectric insert rather than a resin. When this embodiment is used, the channel would be machined slightly oversized to accommodate insertion of the solid dielectric bar. Once inserted, the bar would be held in place using adhesive with a lower dielectric constant matched to that of the surrounding material. The adhesive would fill any voids between the solid dielectric bars and the surrounding material. The adhesive preferably has a dielectric constant matched to the surrounding material.

The use of a solid dielectric offers a few advantages over the use of a resin. For example, controlling the dielectric constant of commonly used solid materials is well known. Second, the machining tolerances required using a solid dielectric instead of a resin are more easily obtainable. This is due to the fact that the solid dielectric insert is made from ceramic and ceramic materials are more dimensionally stable than typical low dielectric materials. The high degree of dimensional stability translates into improved machining accuracy.

Phase Shifter Assembly

The phase shifter assembly 26 of the present invention consists of a centrally located phase shifting element, e.g., the plated twin toroid shown in FIG. 4*e* and two (2) matching transitions, i.e. the transition shown in FIG. 5*d*. The phase shifting element, as shown in FIG. 4*e*, consists of a thin, high dielectric center rib sandwiched between two (2) ferrite toroids. The matching transition 90, as shown in FIG. 5*d*, consists of one or more sections of rectangular waveguide loaded with dielectric material. FIG. 6*a* shows a toroidal phase shifter with a single stage matching transition installed in the waveguide housing.

Conventionally, a toroidal phase shifter and its matching transition need to be almost the exact same height in order to ensure that air gaps above both pieces are minimized. As applications toward higher frequencies are desired, this requirement becomes even more significant. For example, at about 35 GHz, the height differential of less than 0.0005" is significant enough to completely degrade the return loss performance of a well designed matching transition. Conventionally, attempts to solve this problem include utilizing manufacturing techniques which minimize or eliminate differentials in height. At higher RF frequencies, however, the demand placed on such manufacturing techniques becomes impracticable and increases cost significantly.

As shown in FIGS. 6*a* and 6*b*, the phase shifter of the present invention is mounted on a waveguide housing 97. FIG. 6*a* illustrates this housing generally. FIG. 6*b* shows one end of the assembly in an exploded manner. The configuration in FIG. 6*b* allows height differentials to be accommodated between the toroidal phase shifter 86 and its matching transition 90. Specifically, a pliable or compliant membrane 98 is used to create a surface capable of contouring itself to absorb normal irregularities between the toroidal phase shifter 86 and the matching transition 90. In order to maintain electrical continuity, the pliable membrane 98 must be lined with a conductive foil 100. Both the compliant membrane 98 and the conductive foil 100 may be held in place with an adhesive backing.

A rigid cover 102 fixes the compliant membrane 98 and the conductive foil 100 onto the phase shifter assembly 26 via countersunk screws 104. Each of the rigid cover 102, the foil 100, the membrane 98 and the assembly 26 have holes therein for receiving the screws 104.

When assembled, as shown in FIG. 6*c*, the conductive foil 100 forms the top surface of a portion of the waveguide cavity 97. The flat rigid cover 102 and countersunk screws 104 are required to provide a clamping force in the downward direction as well in a horizontal direction. A downward clamping force induced by the countersunk screws 104 causes the compliant membrane 98 and the conductive foil 100 to extrude into any unsupported areas. The amount of extrusion is a function of many factors, including the clamping force, the hardness of the compliant membrane 98, and the thickness and ductility of the conductive foil 100. Screw hole alignment for the countersunk screws 104 is carefully shifted to ensure that a horizontal clamping force will be exerted when the screws are torqued into their final positions. The horizontal clamping force holds the vertical portion of the conductive foil 100 in contact with a waveguide housing 97 as shown in FIG. 6*c*. This horizontal clamping force is crucial to the electrical performance of the phase shifters so that the conductive foil will be properly grounded to the rest of the waveguide housing.

It is further noted that in addition to the application described above, the concept of using compliant membranes 98 covered or plated with conductive sheets 100 can be utilized in a variety of geometries to provide a low cost way of improving grounding contact in RF circuits.

Precision Forming of RF Manifolds

As noted above, the ability to control the dimensions of the manifolds is important in the present invention. However, the conventional process used to join the pieces of waveguides, brazing, introduces large distortions to the parts due to the extreme temperatures required.

The concept for fixturing the manifold for brazing and heat treatment is shown in FIG. 7*a*. The fixturing consists of a large crate 108 consisting of an upper crate portion 110 and a lower crate portion 112. The crate holds a manifold 114, which may be any of the manifolds previously discussed. An upper U-shaped channel 116, a lower U-shaped channel 118, and a compression spring 120 spread the load across the joint and secure the manifold 114 within the crate 108.

FIG. 7*b* shows a detail of the circled portion in FIG. 7*a* of the brazed joint before brazing. The body of the manifold, of which only a portion of the manifold wall can be seen in FIG. 7*b*, is machined from a clad plate, preferably an aluminum plate with a thin layer of braze material 126 on the surface thereof. A chamfer 130 is machined into the top of the manifold wall 128 in order to control the amount of brazing material and minimize the radius. This brazing material 126 is for joining the manifold wall 128 with a manifold cover 124. A clamping plate 122 helps evenly distribute the force applied by the lower U shaped channel onto the joint. The ends of the lower U-shaped channel 118 are positioned directly above each joint. In particular, as can be seen from FIG. 7*b*, the lower U-shaped channel 118 preferably is matched to the manifold wall.

The upper crate portion 110 allows for placement of the upper U-channel 116 to be used in securing the compression spring 120. Pressure is applied using the compression spring 120. The lower crate portion 112 includes heavy monel or stainless steel bars 132 that run perpendicular to the joint of the manifold. The bars 132 are of a much greater mass than the manifold being brazed, thus preventing the manifold from moving due to the pressure exerted thereon. Such prevention avoids distortion of the manifold and maintains consistent dimensions from piece to piece. Traditionally, there is a significant interpart variation due to growth or shrinkage.

Magic Tee

Conventional waveguide magic tees, as shown in FIG. 8, have a sum port 130 and a difference port 131. In the conventional magic tee, the difference port 131 projects above the tee structure. When a low profile design is desirable, such a structure presents problems. A 90° bend could be used to fold the difference channel over, but the tee is inherently sensitive to structures placed too close to the junction of the ports. To minimize interactions with the tee, the bend must be placed greater than one half of a wavelength from the tee junction which requires more space for implementation. Also, the tee is usually cast aluminum which must be purchased separately and integrated into an assembly.

The design for the tee for use with the present invention, i.e., in the horizontal elevation manifold, provides the lowest tee profile possible by incorporating the 90° bend just above the junction. The tee of the present invention, as shown in FIGS. 9*a* and 9*b*, can be directly machined into a waveguide assembly. The design shown in FIGS. 9*a* and 9*b* have a reduced height waveguide application. The form factor of this design resembles a conventional tee, except discrete reactive elements are needed near the junction. The operational bandwidth of the tee of the present invention is comparable to that of conventional designs. Impedance matching is achieved in the 45° corner design, a transformer in the sum and difference channels, and the slot shown in the common wall between the three co-planar channels and the difference channel. In FIG. 9*b*, a transformer is in the sum channel. The difference channel can be matched with a stub or a stopped transformer.

The magic tee shown in FIGS. 9*a* and 9*b* is bi-planar, i.e., the axes along the sum and difference channels will not intersect. This facilitates its manufacture in that the tee can be machined and brazed into a waveguide assembly. The sum channel 130 and two collinear channels 133, 134 occupy one plane and the difference channel 132 is in the adjacent plane. The two collinear channels 133, 134 behave as two higher impedance channels, with respect to the sum channel, which combine in parallel.

The sum channel has a lower impedance that must be matched with a quarter wave transformer and a 45° corner feature 135. The position of the difference channel 132 and design of a slot 137 in a common wall 136 between the coplanar channels 130, 133, 134 and the difference channel serve to impedance match the difference channel.

Radiators

In order to achieve the required radiator spacing in the antenna beam scan plane, the radiators were dielectrically loaded with, for example, polystyrene, to reduce their size. In constructing a dual polarized phased array antenna of the present invention, using a dielectric filled waveguide element allows low manufacturing cost per element, compactness, functionality and low weight compared to standard metallic equivalents. Illustrations of such elements are shown in FIGS. 10*a* and 10*b*.

FIG. 10*a* illustrates a vertical polarized radiator 58. FIG. 10*b* illustrates a horizontal polarized radiator 56. Both radiators includes a dielectric waveguide 169 having a raised pad 170, an RF window 172, a short circuit 174 and staking posts 176. The dielectric waveguide 169 may also include RF/mechanical serrations 171 for fitting with a coupler. The manifolds distribute energy from the air waveguide into the dielectric waveguide via a coupling slot shown in FIG. 11*b*, and discussed in detail below. The coupling is facilitated by the RF window 170 and the raised pad 172 thereon of each radiator. Each radiator is attached to the air waveguide using the impedance matched staking posts 176 on either side of the RF window.

The vertical radiator shown in FIG. 10*a* has a flare 178, a twist 180, matching steps 181 and a vertical radiating aperture 182. The vertically polarized radiator 58 also includes impedance matching features 184. The twist 180 is customized to simplify the injection molding operation and to eliminate interference with the horizontal radiator 56. Matching features of the vertical radiator are molded into the design, discussed below regarding the ground plane and impedance matching.

The horizontal radiator 56 shown in FIG. 10*b* includes a flare and offset 186. This flare and offset 186 displaces a horizontal radiating aperture 188 from a centerline, allowing the horizontal radiator to be in proper position. The horizontal radiator also includes impedance matching stubs 160 and ground plane stubs 150. These matching features in the horizontal radiator 58 are molded directly into the element to maximize the efficiency of the array. The ground plane stubs 150 are formed into the waveguide wall at the end of the horizontal radiator 56.

The dielectric waveguide elements that connect the feeding manifold to the radiating aperture is illustrated in FIGS. 10*a* and 10*b*. The dielectric waveguide 169 is composed of a low loss injection molded dielectric plastic with a metallized plating on the outside to form a waveguide. These elements incorporate all of the necessary RF and mechanical features needed to route the RF energy to the radiating aperture. The manifold distributes energy from the air waveguide into the dielectric waveguide via a coupling slot. This is facilitated by the RF window 170 and the raised pad 172 that is molded into the dielectric element.

The element is attached to the air waveguide structure using two impedance matched posts 176 that are molded on either side of the RF window 170. Note that both the horizontal and vertical polarized radiators are similar as described above.

Each element is molded in a two part mold. This necessitates the use of tapers or molding draft and ejection pins in the mold wherever possible. Tapers are placed on the edges of the twist on the impedance matching features of each radiator and on the ground plane stubs of the horizontal radiators. The RF designs includes the effects of all features required in tapers. The ejection pins leave a slight impression on the molded elements which are matched on the opposite side of the waveguide wall.

Waveguide Coupler

Figure 11A:
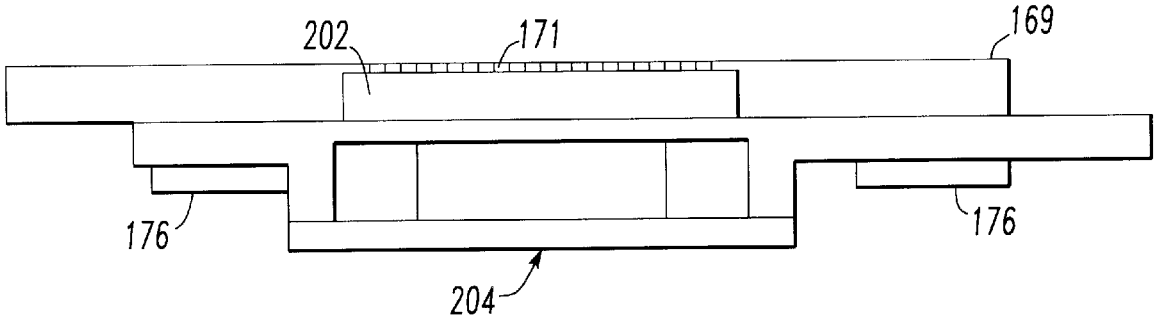
FIG. 11*a* is a side view of an interconnected manifold and radiator.
Figure 11B:
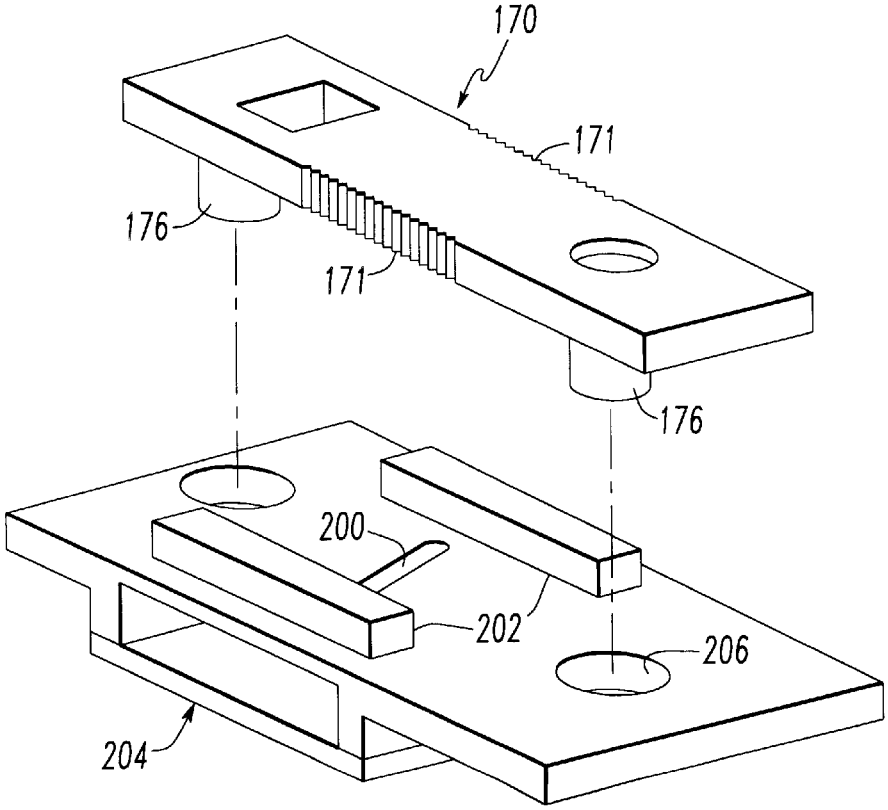
FIG. 11*b* is a perspective exploded view of the interconnected manifold and radiator in FIG. 14*a;*

In accordance with the present invention, for the components described immediately above, a coupler for coupling an air waveguide to a dielectric wave guide is required. The coupler can be either directional or nondirectional. The cross-guide design shown in FIGS. 11*a* and 11*b* is a preferred configuration. Since the vertical and horizontal radiators differ in the design of their respective radiating apertures, not in the dielectric waveguide itself, the radiators will be referred to generally below.

The energy emerging from the air waveguide couples into the dielectric waveguide through coupling slot or slots 200 that are placed in the wall of the air waveguide 204. The plated dielectric waveguide 169, as shown in FIGS. 10*a* and 10*b*, has a small raised pad in the coupling area of the coupler which has the plating removed to form the coupling window 172. The use of a raised pad ensures that the dielectric waveguide 169 contacts the surface directly around the coupling slot 200. The pad also aids in the removal of the plating. The RF window 172 has metal on the sides of the pad to ensure that an RF seal is obtained across the broad wall of the dielectric waveguide 169.

Metal bars 202 are formed into the air waveguide 204 to align the dielectric waveguide 169 to the coupling slot 200 in the wall of the air waveguide 204. The spacing between the bars 202 on either side of the coupling slot 200 is chosen to cut off radiation that may leak between the dielectric waveguide 169 and the outer wall of the air waveguide 204. The serrations 171 on the walls of the dielectric waveguide 169 are designed to allow a slight interference fit between the parts to form an RF seal. The depth and spacing between the serration 171 are minimized to choke off RF radiation from the dielectric window 172. The serration 171 are not required.

Electronically scanned antennas require very small spacings between radiating elements to prevent grating lobes from moving into real space. When transmission losses are critical, waveguide type radiators which are low loss are a preferred type of transmission media. The spaces required, air waveguides 204 may be too large and the dielectric waveguide 169 using a higher dielectric must be used. Attachment of the dielectric waveguide 169 to the air waveguide is critical. The dielectric waveguide with its locating and staking post is shown in FIG. 11*b* before the assembly into the air waveguide. Also shown are the serrations 171 on the dielectric that are used to position between the guide bars 202 on the air waveguide 204. The air waveguide 204 has holes 206 drilled to accept the staking posts 176 of the dielectric waveguide. The assembled dielectric waveguide and air waveguide with stake posts is shown in FIG. 11*a*.

The dielectric waveguide must be made of a thermoplastic type material. This allows for the use of an ultrasonic horn to the melt the dielectric locally in the area of the post in order to secure it in the air waveguide. One of the staking posts should be used for positioning the dielectric with respect to the air waveguide. The second post may be used for positioning, but in the application shown in FIG. 11*a*, is used only for securing the dielectric to the air waveguide. Once the dielectric has been placed in position on the air waveguide, and ultrasonic horn is brought down onto the posts. The dielectric is melted locally at the top of the post and is forced down by the movement of the horn. Upon reaching a specified depth, the horn is withdrawn leaving a small button visible as seen in FIG. 11*a*.

Compact Short

Figure 12A:
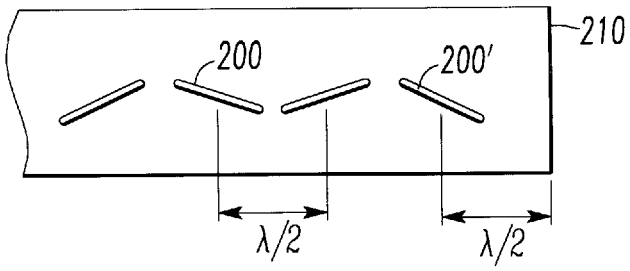
FIGS. 12*a*–12*c* illustrate the use of a conventional short.
Figure 12B:
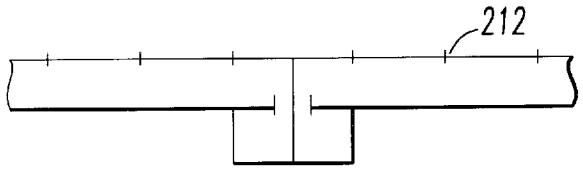
Figure 12C:
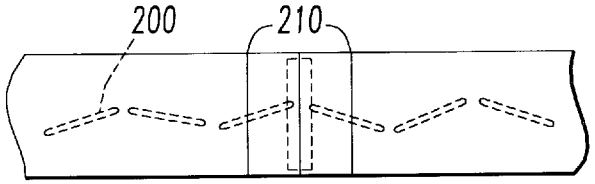

When using a resonant slotted waveguide feed or manifold in which series slots are employed as in the present invention, in order for the series slots to couple energy or radiate, the last coupling slot 200 in the circuit must be grounded with a short circuit. This can be accomplished by placing a short 210 180° or one half of a wavelength away from the last coupling slot 200'. It is often desirable to keep the short 210 in the same plane as the waveguide which feeds the slots 200. This is shown in FIG. 12*a*. When space is not available in the feeding waveguide in plane, the short can be folded back 180° relative to a slot wall 212, as shown from the side in FIG. 12*b* and from the top in FIG. 12*c*. However, some applications do not have the space available for the such a space conserving folding configuration shown in FIGS. 12*b* and 12*c*.

Therefore, the short of the present invention consists of a shorted wall placed approximately one quarter of the wavelength of the feeding waveguide from the desired reference plane. The capacitive stub creates the additional phase required to achieve the desired results.

Figure 13A:
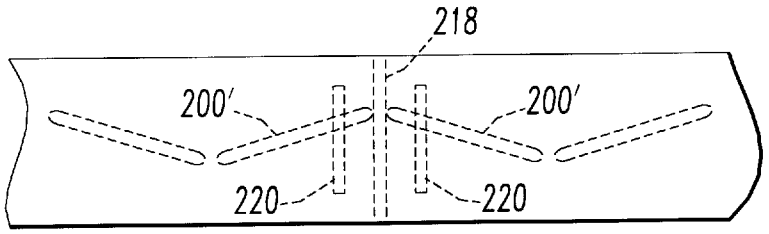
FIG. 13*a* is a top view of the compact short of the present invention.
Figure 13B:
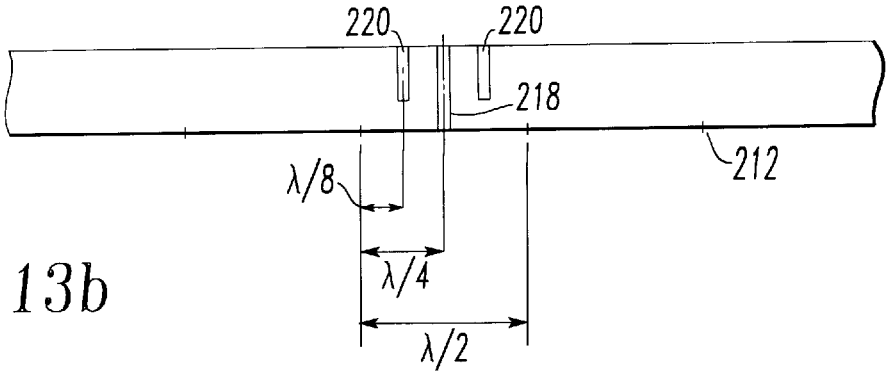
FIG. 13*b* is a cross section of the compact short in FIG. 13*a;*

The configuration, shown from the top in FIG. 13*a* and from the side in FIG. 13*b*, provides an equivalent short circuit 216 from a shorted transmission line 218 placed to the distance of only one quarter wavelength from the reference plane. i.e., the center of the last coupling slot 200'. This is accomplished by placing a large capacitive stub 220 one-eighth of a wavelength from the desired reference plane. The short circuit can be transformed one-eighth of the wavelength to the plane of the capacitive stub 220.

This transformed short 218 has normalized susceptance of −J1. The capacitive stub 220 must have a normalized susceptance of +J2 so that the two reactants as combined, the admittance at the stub plane is +J1. The admittance is then transformed one-eighth of a wavelength to the desired reference plane to appear as a short circuit. This is accomplished in one quarter of a wavelength.

If the compact short 216 is applied to a manifold which feeds slots 200 on both sides of the shorted waveguide wall, the capacitive stub can be adjusted to provide slightly more susceptance and +J2 because the shorted wall has a finite thickness which requires the short to be less than one quarter wave from the last slot. The compact short shown in FIGS. 161 and 16*b* has the same basic characteristics as a quarter wave short, thus extending the operating band width. The compact short also experiences one half the reflection phase variation over frequency in the conventional short.

While the configuration discussed above is in connection with a waveguide, the compact short may be applied to any transmission line.

Ground Plane

Densely populated radiators in a phased array antenna present assembly problems in how they are terminated into the ground plane. The radiators of the present invention, rather than using the typical method of fabricating a metal face plate, uses ground plane stubs, matching stubs, and conductive epoxy filler for completing the continuous ground plane. The triangular shape of projections was chosen to facilitate assembly, minimize the impact of impedance discontinuity and the radiator waveguide and to provide interrupting benefits. The triangular projections are split on each side of the waveguide to minimize the RF discontinuity of the stubs. The ground plane is made electrically continuous by filling any cracks therein with a conductive epoxy. These cracks only need to be filled by discrete locations. A more detailed description of this configuration is set forth in U.S. application Ser. No. 08/680,304 filed Jul. 11, 1996, which is hereby incorporated by reference.

An array radiator grid 140 is shown in FIG. 14. The array 140 is composed of horizontally polarized radiators 56 and vertically polarized radiators 58. As can be seen in FIG. 14, an intra-row gap 142 between adjacent vertically polarized radiators 58 and an inter-row gap 144 between adjacent horizontally polarized radiators 56 and vertically polarized radiators 58 are both relatively small such that there is little ground plane surface therebetween. However, a spacing 146 between adjacent horizontally polarized radiators 156 is relatively large. Typically, the spacing 146 is approximately an order of magnitude larger than either the intra-row gap 142 and the inter-row gap 144. The radiators 56, 58 are impedance matched under the assumption that there is a continuous ground plane surrounding them. The intra-row gap 142 and the inter-row gap 144 are small enough that they only need to be filled at critical nodes such that there is a connection provided, especially regarding the inter-row gap 144. Otherwise, leaving these gaps unfilled does not seriously affect this assumption. However, the spacing 146 must be substantially filled in order for the array 140 to perform properly, i.e., the spacing 146 must be reduced such that the continuous ground plane assumption is not seriously affected.

A preferred embodiment of filling the spacing 146 is shown in FIGS. 11*a*–11*c*. In these figures, the ground plane is incorporated into the radiators. Ground plane stubs 150 integrated with the horizontal radiators 56 create most of the ground plane surface after the radiators are assembled together. A ground plane formed by the ground plane stubs 150 is made electrically continuous by filling ground plane voids 152 therein with a conductive filler 154. The ground plane voids 152 represented by the intra-row gap 142 and the inter-row gap 144 must clearly also be filled at least to the extent required to provide continuous contact. The ground plane voids 152 only need to be filled with the conductive filler 154 at discrete locations at sample fill points as shown in FIG. 11*c* as long as the spacing of the fill points is less than about a quarter of a wavelength. Clearly when fully filled, there will be contact between all adjacent surfaces.

Alternatively, the entire plane of the array 140 may be filled with the conductive filler 154 and then skimmed to fill in the voids 152. The conductive filler 154 may be, for example, a conductive epoxy or metallized bond film.

The ground plane stubs 150 preferably include chamfers 156 molded therein. The chamfers 156 facilitate the filling of the voids 152 and allow the ground plane in a certain surface, i.e., flush with the surface of the radiators, to be flat.

Preferably, the ground plane stubs 150 are in the form of triangular projections as shown in FIGS. 15*a*–15*c*. The triangular shape facilitates assembly, minimizes the impact of the impedance discontinuity in the radiator waveguide and provides interlocking benefits. The triangular ground plane stubs 150 are impedance matched with a stub iris 158, shown in FIG. 15*b*, which projects into the dielectric waveguide of the horizontal radiator 56. A ridge 160 also provides impedance matching in the waveguide.

Also preferably, the ground plane stubs 150 are provided, for each radiator 56 having ground plane stubs 150 integrated therewith, on opposite surfaces, e.g., 162, 164, of the radiator 56. Further, each surface 162, 164 of the radiator 56 preferably includes two ground plane stubs 150*a*, 150*b* or 150*c*, 150*d*, respectively. The upper ground plane stubs 150*a*, 150*c* are mirror images of lower ground planes stubs 150*b*, 150*d* about a central horizontal axis 166. The upper ground plane stub 150*a* of the first surface 162 is a mirror image of the lower ground plane stub 150*d* of the other surface 164 about a central vertical axis 168. Similarly, the lower ground plane stub 150*b* of the first surface 162 is a mirror image of the upper ground plane stub 150*c* of the second surface 164 about the axis 168. When the radiators 56 are arranged such that the first surface 162 of a radiator faces the other surface 164 of an adjacent radiator, as shown in FIGS. 15*a* and 15*c*, a desirable interlocking pattern is formed.

The ground plane stubs 150 are preferably offset below the surface of the front plane of the radiators 56. This allows the radiator's aperture to be metallized during construction and the metallization to then be selectively removed from the radiators without affecting metallization on the ground plane stubs 150. If the radiators are injection molded, the ground plane stubs 150 are preferably injection molded along with the horizontally polarized radiators 56 with which they are integral.

There are several mechanical benefits of using ground plane stubs 24 integrated with the horizontally polarized radiators 16 as compared to a continuous fabricated ground plane. The weight of the design is reduced, assembly problems of inserting many radiators through a common surface is alleviated, and no additional hardware is required to attach the radiators to the ground plane.

Impedance Matching

Without any impedance matching, the radiators are inherently poorly matched to free space due to the grid spacing of the radiator size is required for efficient beam scanning. If the antenna aperture is not matched to free space, power will be reflected back toward the generator, resulting in a loss in radiated power. Further, a mismatch produces standing waves on the feed line to the antenna. In a scanning array, the impedance of a radiating element varies as the array is scanned, thereby complicating the matching problem.

The dual polarization of the configuration of the present invention adds even further complication to the matching problem, since such dual polarization requires the interleaving of two arrays with different impedance environments. The layout of the dual polarized array shown in FIG. 14 isolates the energy of the two polarizations. This isolation improves cross polarization performance.

In accordance with the present invention, this problem is overcome by the configuration shown in FIG. 16*a*. FIG. 16*a* includes a wide angle impedance matching (WAIM) sheet 190, a spacer sheet 192, vertically and horizontally polarized waveguide radiators 182, 188, and matching features 184, 160 molded into the dielectric waveguide radiators 182, 188, respectively. The matching feature analysis is performed without the presence of the other radiator, but performance is verified with both radiators present. Thus, there are impedance matching features at two levels.

At the first level, matching is achieved with the WAIM sheet 190. The WAIM sheet 190 is an electrically thin, relatively high dielectric, e.g., greater than or equal to six, sheet spaced electrically close, e.g., within 0.02 inches, to the radiators. The WAIM sheet 190 provides the majority of the impedance match for both polarizations as a function of scan angle. The WAIM 190 sheet works best when it is separated from the array by air. A practical method to hold the WAIM sheet 190 in place is to attach it to a low dielectric sheet that serves as the spacer sheet 192 between the WAIM sheet 190 and the array. The spacer dielectric is preferably less than or equal to 1.2.

The second level of impedance matching is achieved by modeling matching features 184, 160 directly into the dielectric waveguide radiators 182, 184. The vertical radiator 58 is matched using an inductive iris 184 to the aperture 182 as shown in FIG. 16*b*. The horizontal polarized radiator 56 uses a matched transformer section 160 in the waveguide which feeds another wider transformer section directly to the aperture 184 as shown in FIG. 16*c*. Since these matching features are molded into the radiators, the manufacturing complexity is minimized.

Conclusion

Thus, by utilizing the above components, the desired structure of a dual polarized, electronically scanned phase array having congruent elements may be realized.

The invention being thus described, it will be apparent that the same may be varied in many ways. For example, other shapes, such as rectangles, may be used for the ground plane stubs. Such variations are not to be regarded as a departure from the spirit and scope of the invention, and such modifications as would be obvious to one skilled in the art are intended to be included within the scope of the following claims.

What is claimed is:

1. A phased array comprising:

a first plurality of radiators having a first polarization and including a first coupling portion, a first radiating aperture, and a twist portion connecting said first coupling portion to said first radiating aperture;

a second plurality of radiators having a second polarization, different from said first polarization and including a second coupling portion, a second radiating aperture, and an offset portion connecting said second coupling portion to said second radiating aperture; and, means for positioning said first and second plurality of radiators such that radiating patterns of said first and second plurality of radiators are congruent.

2. The phased array according to claim 1, wherein said first and second plurality of radiators are used alternately during transmission and simultaneously during reception.

3. The phased array according to claim 1, wherein said means for positioning includes means for mating said first and second plurality of radiators together.

4. The phased array according to claim 1, wherein an assembly of said first plurality of radiators includes a first azimuth manifold assembly, a second azimuth manifold assembly, each manifold assembly being connected through a respective phase shifter to a respective twist portion.

5. The phased array according to claim 4, further comprising means for connecting said first azimuth manifold assembly and said second azimuth manifold assembly to one another.

6. The phased array according to claim 1, wherein said first coupling portion includes a manifold assembly;

said twist portion includes a twist plate; and a phase shifter connecting the manifold assembly and the twist plate.

7. The phased array according to claim 6, wherein said twist plate includes a double ridged waveguide having section rotated with respect to incoming and outgoing waveguides, said section additionally having side walls which are split in two paths extending across the respective incoming and outgoing waveguides.

8. The phased array according to claim 6, wherein said phase shifter comprises a toroid phase shifter.

9. The phased array according to claim 8, further comprising phase matching transitions at an input and output of the phase shifter.

10. The phased array according to claim 9, wherein said phase matching transitions include at least one dielectric layer in a channel of a block, said at least one layer having a higher dielectric constant than said block.

11. The phased array according to claim 9, wherein said phase shifter comprises a toroid phase shifter which includes a housing and means for mounting said toroid phase shifter and said phase matching transitions in said housing.

12. The phased array according to claim 11, wherein said means for mounting includes a compliant member for accommodating height differences between said toroid phase shifter and said phase matching transitions.

13. The phased array according to claim 12, wherein said compliant member covers a portion of said toroid phase shifter and a portion of said phase matching transition and said means for mounting further includes a conductive member between said compliant member and portions of said toroid phase shifter and said phase matching transitions.

14. The phased array according to claim 1, means for delivering energy to and from said first and said second plurality of radiators.

15. The phased array according to claim 14, wherein said means for delivering energy includes a difference channel connected to a top of a first manifold of said first plurality of radiators and to a top of a second manifold of said first plurality of radiators.

16. The phased array according to claim 15, wherein said means for delivering energy further includes another difference channel connected to a side of the first manifold and to a side of said second manifold.

17. The phased array according to claim 15, wherein said means for delivering energy further includes a summation channel connected to a side of the first manifold and to a side of said second manifold.

18. The phased array according to claim 15, wherein said difference channel occupies a plane adjacent to a plane of a summation channel between said first and second manifold.

19. The phased array according to claim 18, further comprising a common wall between said difference channel and said summation channel, said common wall having a slot therein, wherein a position of said difference channel relative to the slot impedance matches the difference channel.

20. The phased array according to claim 18, further comprising two collinear channels orthogonal to and in the plane of the summation channel and a corner feature which matches impedance of said two collinear channels and the summation channel.

21. The phased array according to claim 14, wherein said means for delivering energy includes a difference channel connected to a bottom of a manifold of said second plurality of radiators and a summation channel on a side of said manifold.

22. The phased array according to claim 14, wherein said means for delivering energy includes a calibration channel connected to a manifold of said first plurality of radiators and to a manifold of said second plurality of radiators.

23. The phased array according to claim 1, further comprising manifolds which transfer energy to and from said first and second plurality of radiators, and said first and second coupling portions include dielectric waveguides which couple the manifolds to first and second radiating apertures.

24. The phased array according to claim 23, wherein said dielectric waveguide includes a coupling window and said manifold includes a coupling slot to be aligned with said coupling window.

25. The phased array according to claim 24, further comprising means for aligning said dielectric waveguide and said manifold.

26. The phased array according to claim 25, wherein said means for aligning includes staking posts in said dielectric waveguide and corresponding holes in said manifold.

27. The phased array according to claim 25, wherein said means for aligning includes bars on either side of said coupling slot.

28. The phased array according to claim 24, further comprising means for preventing leaking of radiation between said dielectric waveguide and said manifold.

29. The phased array according to claim 28, wherein said means for preventing leaking of radiation includes serrations on outer edges of said coupling window.

30. The phased array according to claim 28, wherein said means for preventing leaking of radiation includes appropriately spacing bars on either side of said coupling slot.

31. The phased array according to claim 24, further comprising a raised pad in said coupling window, said raised pad insuring that said dielectric waveguide contacts a region of air waveguide immediately surrounding said coupling slot.

32. The phased array according to claim 24, further comprising a plurality of coupling slots arranged in series, a last coupling slot in said series being grounded with a short circuit.

33. The phased array according to claim 32, wherein said short circuit includes a shorted transmission line one quarter of a wavelength from a center of said last coupling slot and capacitive stub one-eighth of a wavelength from said center of said last coupling slot.

34. The phased array according to claim 1, further comprising ground plane stubs integrated into said second plurality of radiators and conductive material providing connections between adjacent radiators.

35. The phased array according to claim 1, further comprising means for impedance matching radiators to free space.

36. The phased array according to claim 35, wherein said means for impedance matching includes providing an inductive iris in radiators of said first plurality and a ridge in radiators of said second plurality.

37. The phased array according to claim 35, wherein said means for impedance matching includes an electrically thin, high dielectric sheet closely spaced from both said first and second plurality of radiators.

38. A method of forming RF manifolds comprising steps of:

providing a clad plate from which a manifold wall is to be formed;

machining the clad plate to form the manifold wall;

positioning a manifold cover on top of the manifold wall via upper and lower portions of a crate assembly;

applying brazing material to the top of the manifold wall; and, applying pressure evenly across a joint formed between the manifold cover and the manifold wall via a pair of U-shaped channels and a compression spring located between the upper portion of the crate assembly and a clamping plate contacting the manifold cover.

39. The method according to claim 38, wherein said step of applying pressure includes providing bars running perpendicular to the joint below the manifold wall, the bars being much heavier than the manifold wall and cover.

40. The method according to claim 39, wherein said step of machining additionally includes machining a chamfer in a top portion of the manifold wall.

* * * * *